US006134757A

United States Patent [19]

Wei

[11] Patent Number: 6,134,757

[45] Date of Patent: Oct. 24, 2000

[54] PROCESSING METHOD FOR SPLITTING THREAD SPOOL

[76] Inventor: Ho-Pin Wei, No. 678, Sec. 2, Yuan-Chi Rd., She-Tou Hsiang, Changhua Hsien, Taiwan

[21] Appl. No.: 09/442,452

[22] Filed: Nov. 18, 1999

[51] Int. Cl.[7] ..... D01D 5/00; D01D 11/02

[52] U.S. Cl. ..... 28/220; 28/282

[58] Field of Search ..... 28/220, 282, 283, 28/217, 219; 57/2.3, 2.5, 264, 97, 1 UN; 264/103, 146, DIG. 47; 19/65 T, 66 T, 65 R

[56] References Cited

U.S. PATENT DOCUMENTS

| | | | |
|---|---|---|---|
| 3,579,765 | 5/1971 | Eshuis | 28/282 |
| 3,702,055 | 11/1972 | Kosaka et al. | 28/273 |
| 3,739,566 | 6/1973 | Smith | 28/282 |
| 5,214,828 | 6/1993 | Neuert et al. | 28/282 |
| 6,032,342 | 3/2000 | Kawabe et al. | 28/283 |

FOREIGN PATENT DOCUMENTS

| | | | |
|---|---|---|---|
| 2199820 | 9/1987 | Japan | 28/282 |

*Primary Examiner*—Amy B. Vanatta
*Attorney, Agent, or Firm*—Bacon & Thomas, PLLC

[57] ABSTRACT

A processing method for splitting thread spool is to: lay a spool of resin thread on a feeding wheel equipped with a broken end lifter; deliver the resin thread through an auxiliary piece and a first yarn cutter; split the resin thread into equalized finer threads in virtue of a plurality of resin wheels and rotators; deliver the split finer thread to undergo rolling of a pressing and positioning roller; and pull the finer thread to reach a winding spool for being wound to form a yarn spool pending knitting into silk socks.

3 Claims, 8 Drawing Sheets

PROCESSING METHOD FOR SPLITTING THREAD SPOOL

BACKGROUND OF THE INVENTION

When talking about silk sock, it is well known that the higher the density of D (Daniel) is, the more tensile the silk sock becomes. The silk sock is rather popular to people, particularly to women, who usually wear it for keeping or plasticizing their legs. However, after a long period of wearing a pair of silk socks, some side effects may emerge, such as blood clogging, fainting, etc due to the stressed legs. On the contrary, a pair of silk socks or panty stockings in lower D renders smooth and comfortable feeling with loose bondage for show-off a pair of enviable feet or legs.

An average fabric shown in FIG. 1 is woven staggeringly up and down in a way that a warp yarn follows a weft repeatedly to form a smooth texture with pleasant touch feeling, which can be extended unlimitedly. A theoretical plain weave shown in FIG. 2 is to weave staggeringly in a way that two warp yarns follow a weft repeatedly to form a texture in limited length that cannot be extended. Further, as shown in FIG. 3, a warp yarn in triple length is stepwise zigzagged through weft yarns to form a texture lack of uniformity in yarn overlapping, bad touch feeling, and relatively higher cost.

Moreover, before knitting a silk sock in low D shown in FIGS. 4, 5, wherein a spool of resin thread (A1) is rolled by a pressing and positioning roller (A2), then wound on a spool (A3) to form a yarn spool pending knitting. When considering market price, a ½ D yarn spool is higher than a 1 D, a ¼ D higher than the ½ D, etc, therefore, it looks worth splitting a purchased spool of resin thread into multiple spools as shown in FIG. 6, for example, to convert it into 4 yarn spools (A3) in ¼ D for producing silk socks in better quality and price, and the way for splitting a yarn spool into more spools is the motive of this invention.

SUMMARY OF THE INVENTION

The primary object of this invention is to convert a low cost yarn spool into several yarn spools in order to lower production cost and create higher profit.

BRIEF DESCRIPTION OF THE DRAWINGS

For a better understanding to the present invention, together with further advantages or features thereof, at least one preferred embodiment will be elucidated below with reference to the annexed drawings in which.

DETAILED DESCRIPTION OF THE PREFERRED EMBODIMENT

Figure 1:
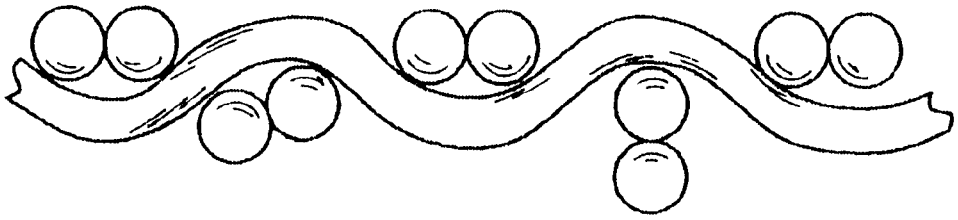
Fig.1 PRIOR ART
FIG. 1 is a schematic view of a mono-weaving texture according to the prior art.
Figure 2:
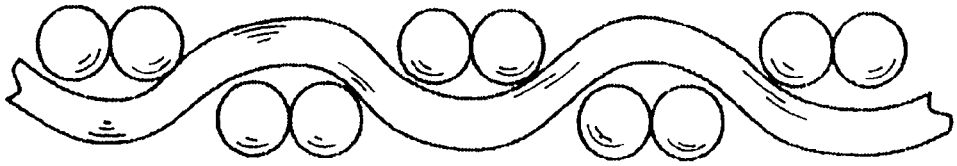
Fig.2 PRIOR ART
FIG. 2 is a schematic view of a plain weave texture according to the prior art.
Figure 3:
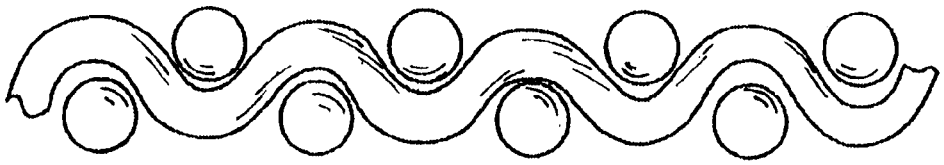
Fig.3 PRIOR ART
FIG. 3 is a schematic view of stepwise zigzagged weave texture according to the prior art.
Figure 4:
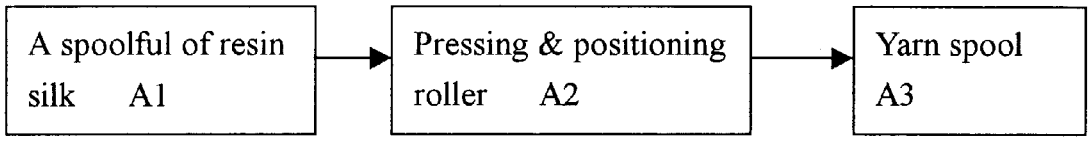
Fig.4 PRIOR ART
FIG. 4 is a flowchart showing a prior method for winding resin thread on a spool.
Figure 6:
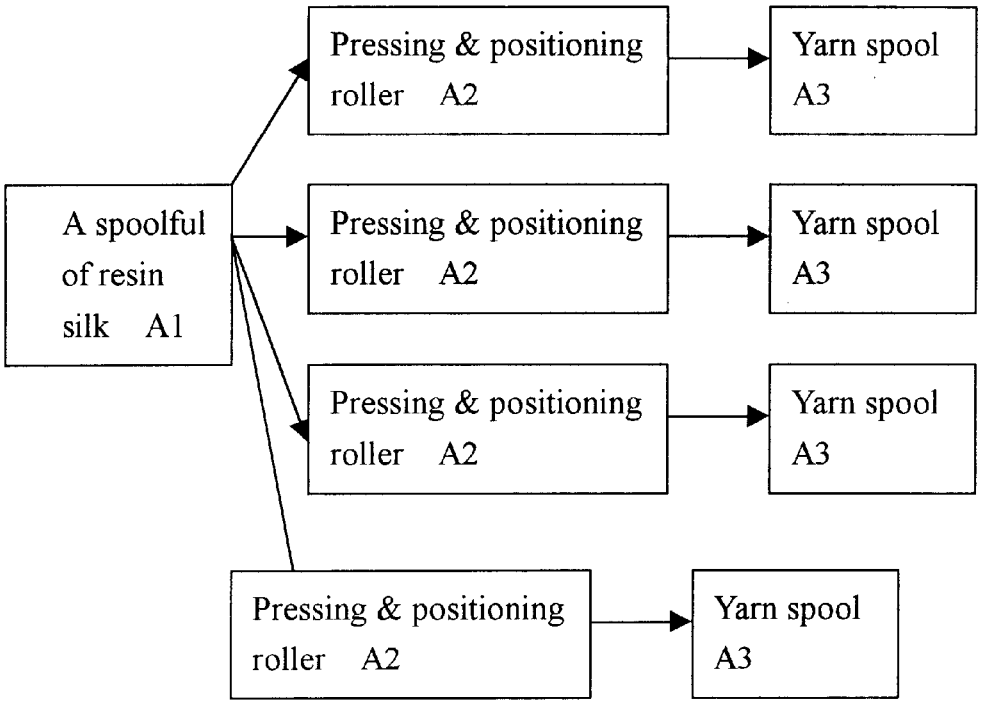
FIG. 6 is a simplified flowchart of thread splitting and yarn winding on a spool of this invention.
Figure 5:
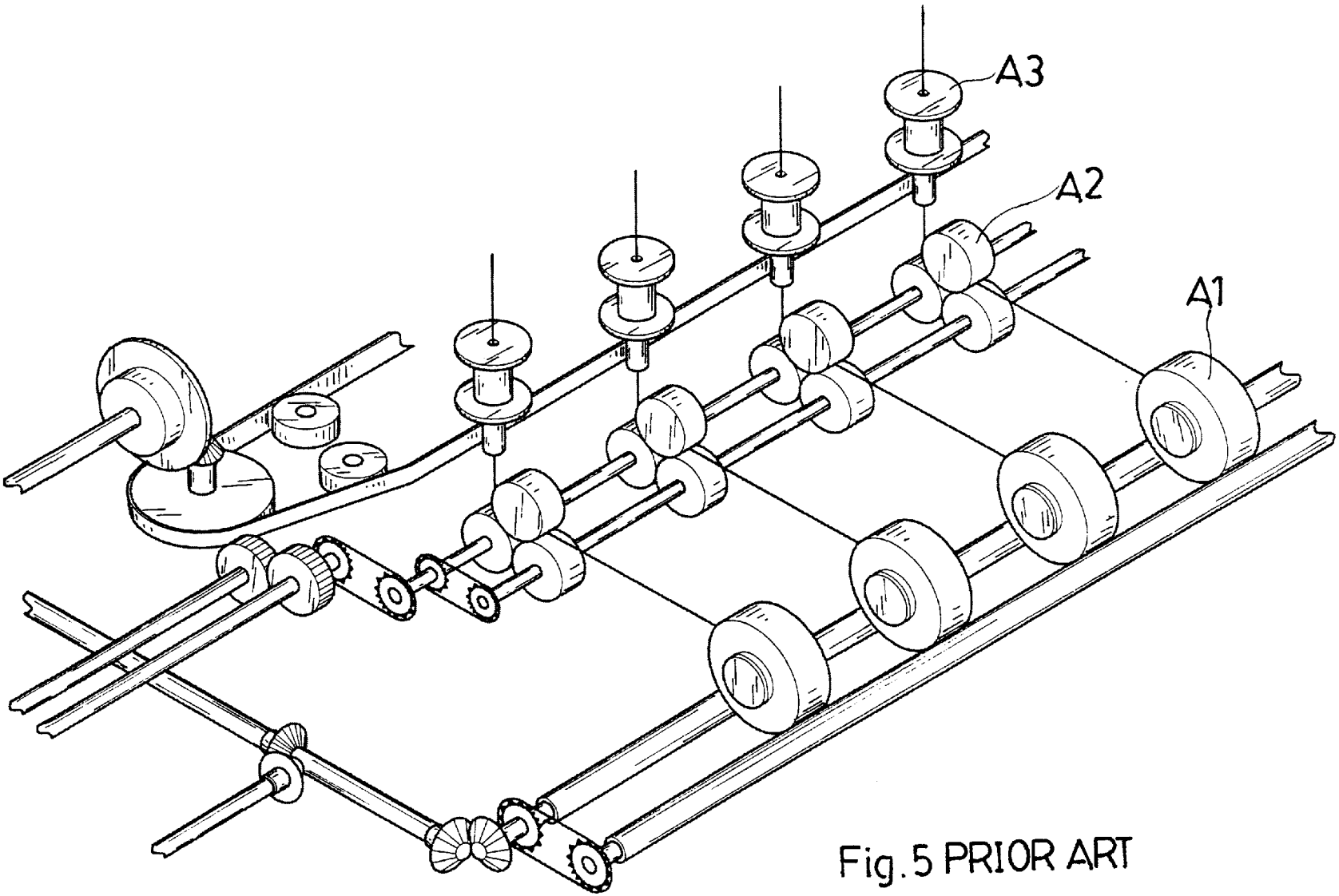
Fig. 5 PRIOR ART
FIG. 5 is a schematic view of winding a prior spool of resin thread on a yarn spool.
Figure 7:
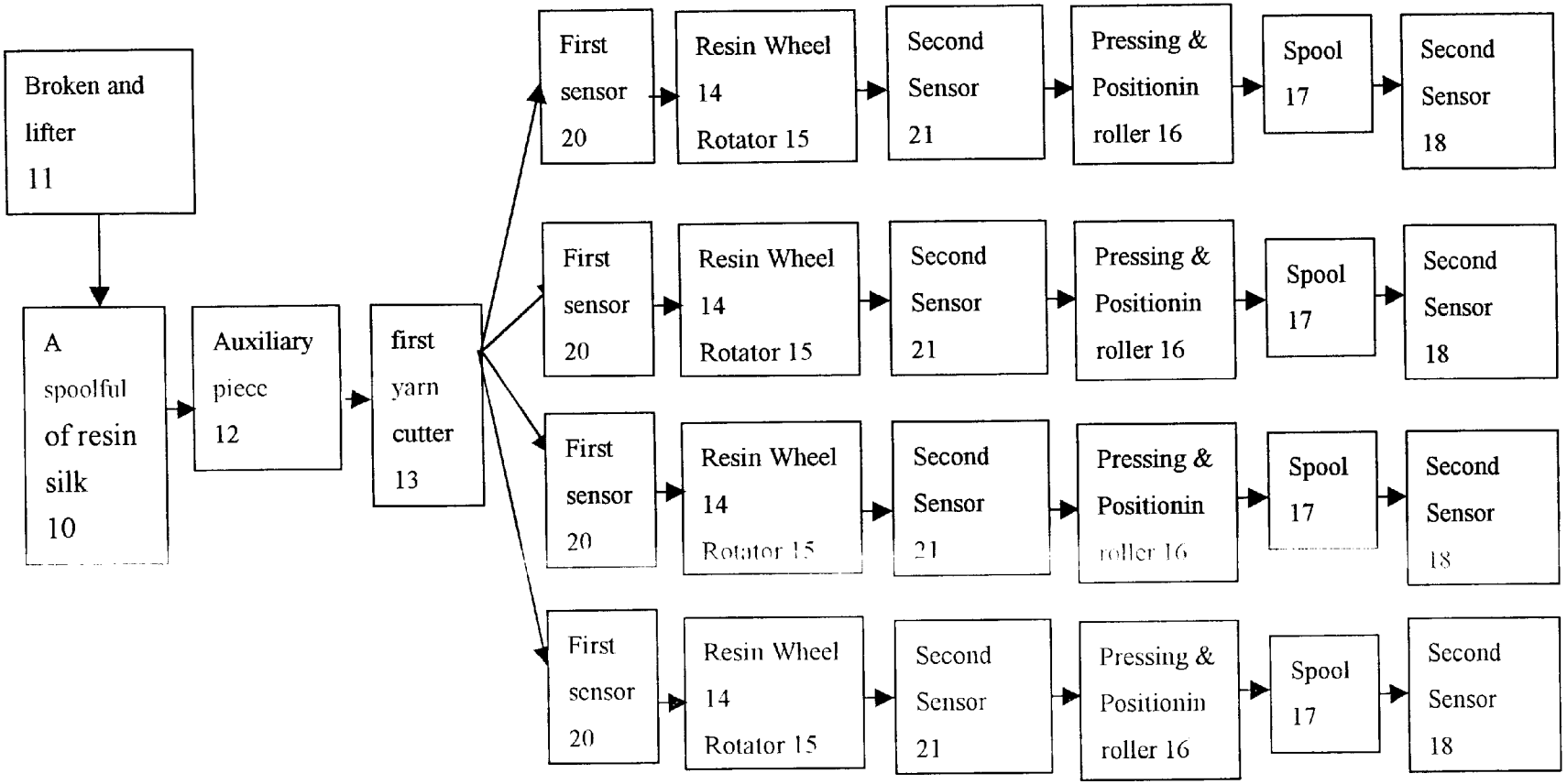
FIG. 7 is a simplified flowchart of a first method of this invention.
Figure 8:
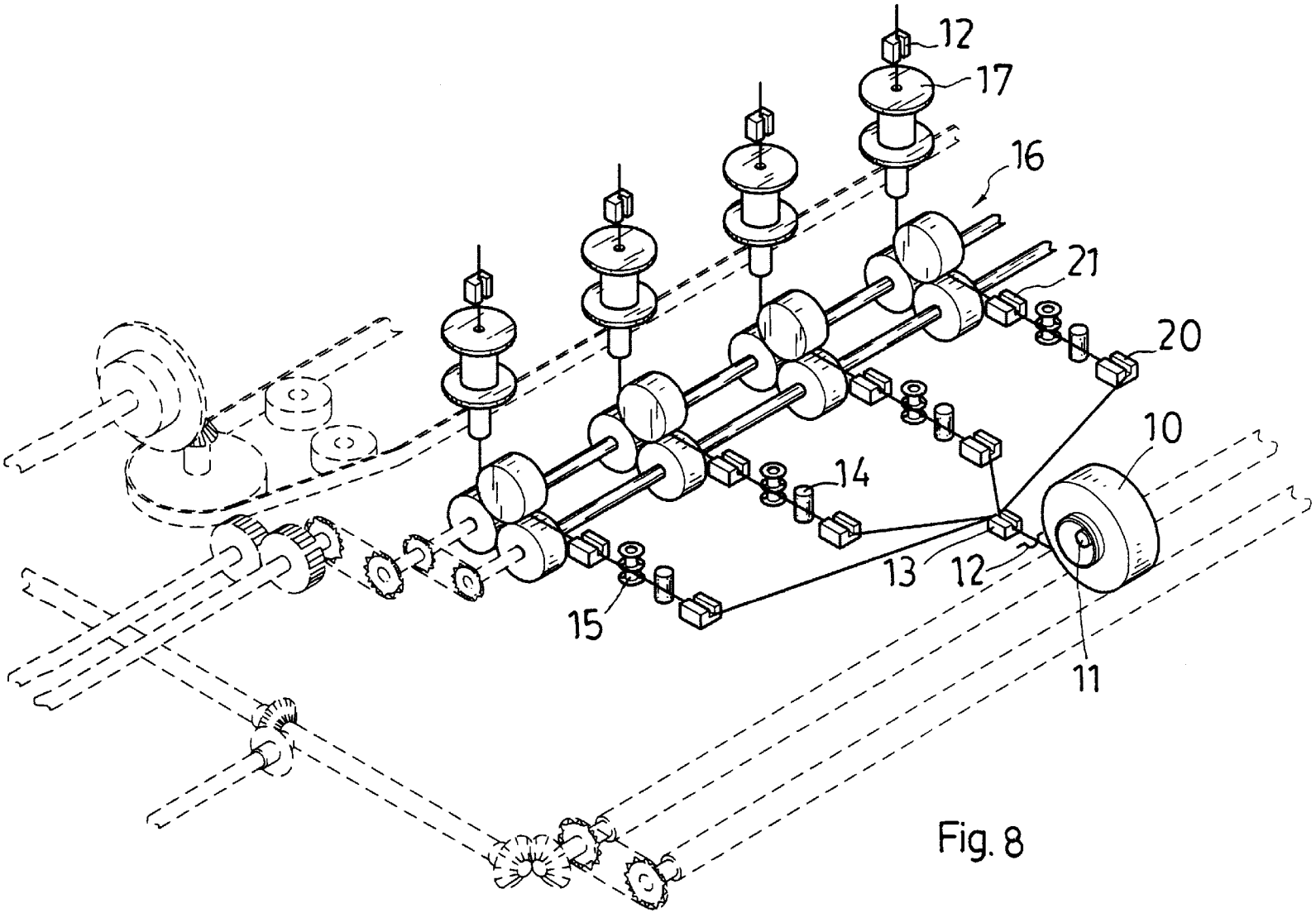
FIG. 8 is a schematic view of the first method of this invention.
Figure 9:
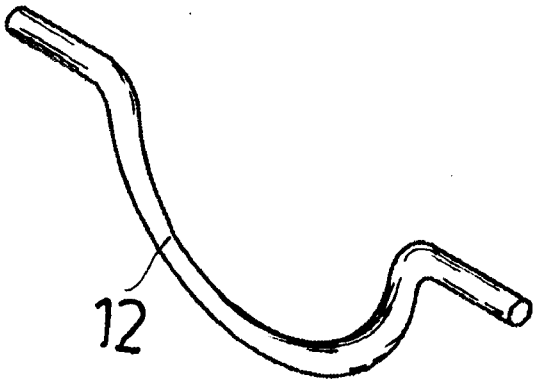
FIG. 9 is an elevational view of an auxiliary piece of this invention.
Figure 10:
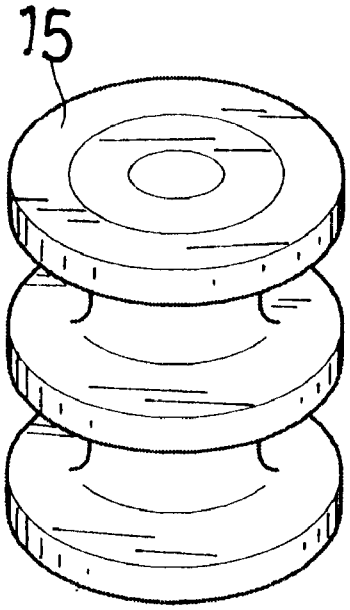
FIG. 10 is an elevational view of a rotator of this invention.
Figure 12:
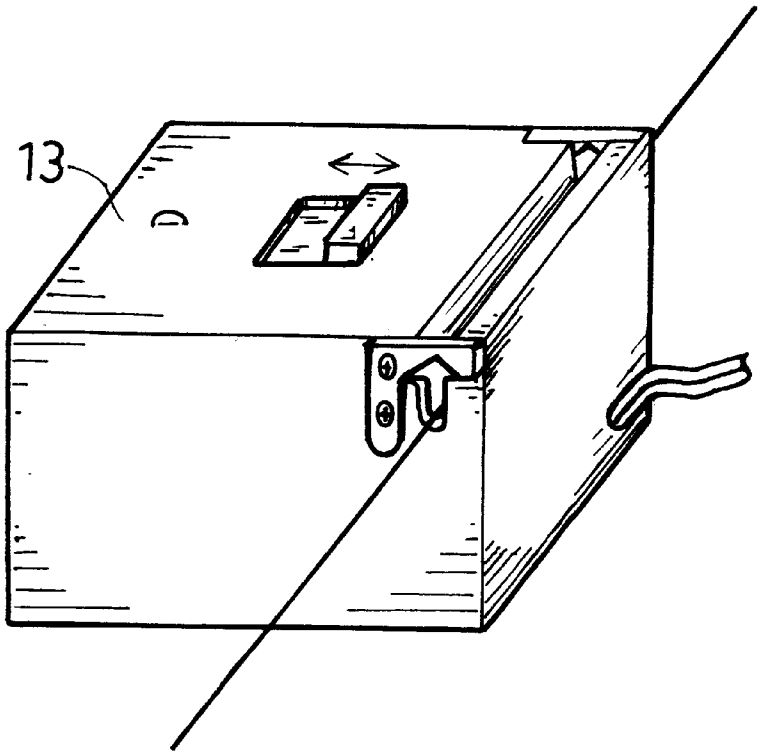
FIG. 12 is a schematic view of a yarn cutter of this invention.
Figure 11:
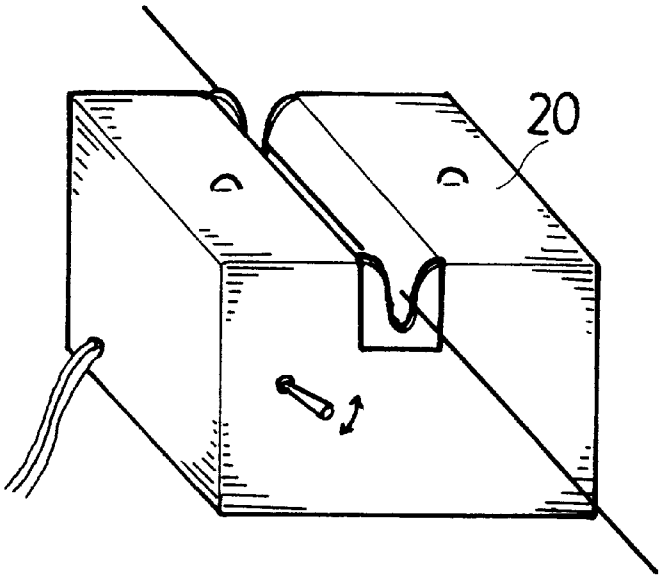
FIG. 11 is a schematic view of a sensor of this invention.

As shown in FIG. 6 through FIG. 12, a method of this invention is to lay a spool of resin thread 10 on a feeding wheel equipped with a broken end lifter 11, which is used to lift the spool of resin thread 10 for separate operation by actuating a motor engaged with a gear wheel. The resin thread 10 is guided through an arched auxiliary piece 12 (shown in FIG. 9) to enable tension of the resin thread 10 to reach a standard uniformity. After passing through a first yarn cutter 13 (shown in FIG. 12), the resin thread 10 is equally split into finer threads in virtue of a traction force created by a resin wheel 14 and a rotator 15 in each row (shown in FIG. 10). In this case, for example, the resin thread 10 is split into four equal parts, and each part undergoes rolling of a pressing and positioning roller 16 to finally reach a winding spool 17 for being wound to form a pending knitting yarn spool, where a second yarn cutter 18 is arranged on the winding spool 17. In addition, a first sensor 20 (shown in FIG. 11) is disposed between the first yarn cutter 13 and the resin wheel 14, and a second sensor 21 is arranged between each rotator 15 and each pressing and positioning roller 16. When any defect or broken end of the split thread is sensed by one of the sensors, the broken end lifter 11 will be effected to lift the resin thread 10 for separate operation.

In abovesaid entire process, this invention is to deliver a resin thread 10 of 1 D to pass through the auxiliary piece 12 to equalize its tension, then, extract four finer resin threads of ¼ D in higher value from the original resin thread 10 in virtue of those four sets of resin wheel 14 and rotator 15. Each split finer resin thread 10 then undergoes rolling of the pressing and positioning roller 16 to finally reach and wind on a winding spool 17 to form a yarn spool pending knitting for creating smooth and nice touch feeling silk socks.

The portion of abovesaid process including the resin wheel 14 and the rotator 15 that can create a traction force for extracting and splitting the resin thread 10 to become four finer resin threads 10 may be substituted by a hollow ceramic tube aligned in a circle to form a rolling wheel, or using a high frequency oscillation piece, or a reciprocal striking piece to enable the original spool of resin thread 10 of 1 D to be split and extracted to similarly form equalized parts in ¼ D.

Figure 13:
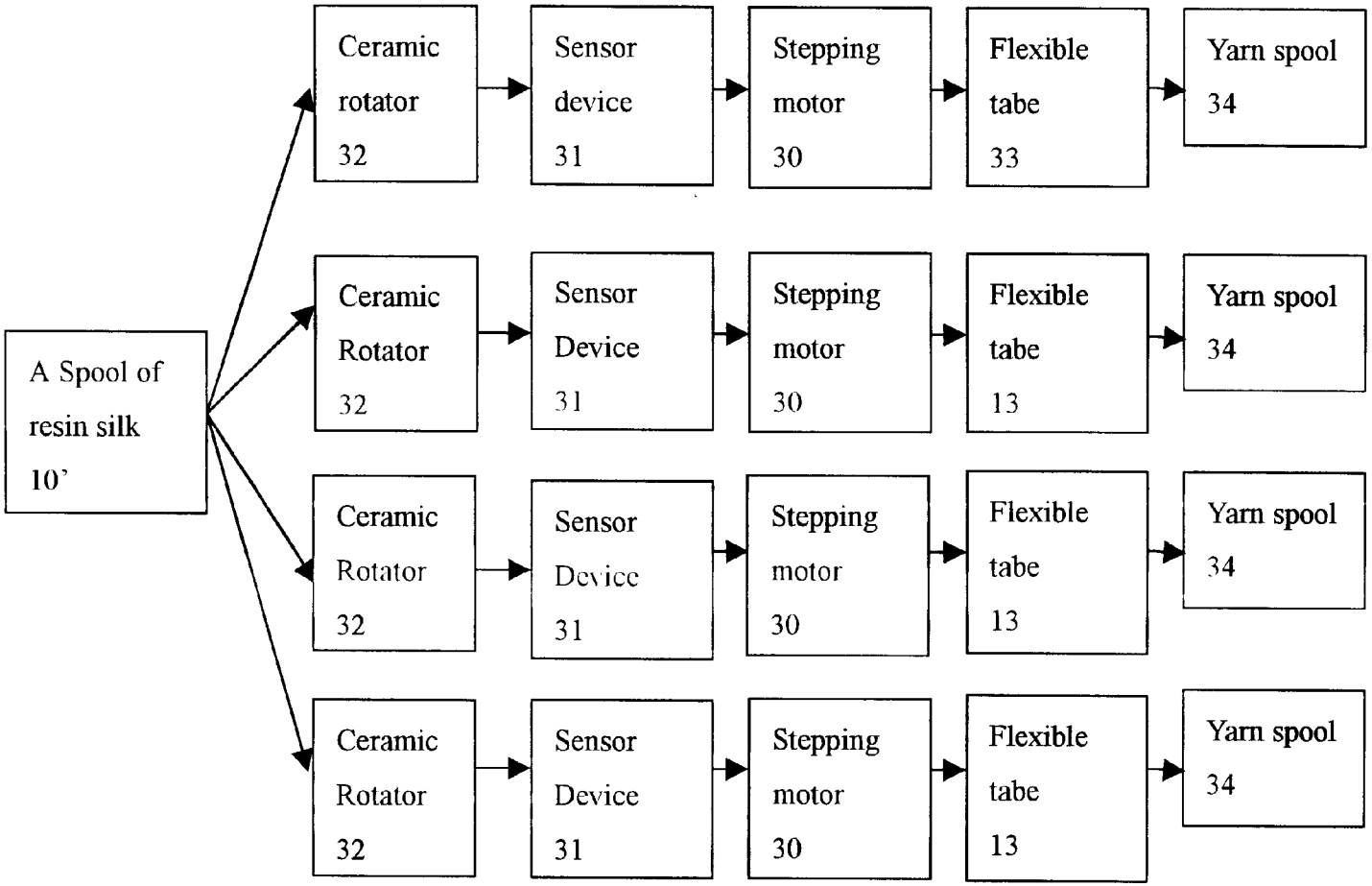
FIG. 13 is a flowchart of a second method of this invention.

Also, as shown in FIG. 13, this invention may take four sets of sensor 31 equipped stepping motor 30 to provide thread extraction and traction power, wherein the stepping motor 30 drives a ceramic rotator 32 and a flexible tube 33 to clamp and tract the resin thread 10 for splitting it into finer threads in ¼ D, then the split finer thread 10' is pulled to reach a winding spool 34 and wound to form a yarn spool pending knitting into silk socks.

By the abovesaid embodiments of this invention, a spool of low price resin thread can be split to form finer yarn spools in higher value for knitting silk socks in better quality that may create a turning point for some makers in this field.

Although, this invention has been described in terms of preferred embodiments, it is apparent that numerous variations and modifications may be made without departing from the true spirit and scope thereof, as set forth in the following claims.

What is claimed is:

1. A processing method for splitting thread spool, comprising:

laying a spool of resin thread on a feeding wheel equipped with a broken end lifter;

delivering said resin thread through an auxiliary piece and a first yarn cutter;

splitting said resin thread into equalized finer threads in virtue of a plurality of resin wheels and rotators;

delivering said split finer thread to undergo rolling of a pressing and positioning roller; and pulling said finer thread to reach a winding spool for being wound to form a yarn spool pending knitting into silk socks.

2. The processing method for splitting thread spool of claim 1, wherein a second yarn cutter is disposed on said winding spool; a first sensor is located between said first yarn cutter and each said resin wheel; and a second sensor is located between each rotator and each pressing and positioning roller; and during splitting, in case a defect is sensed by any of said sensors, said broken end lifter is triggered to lift said resin thread for performing a separate operation.

3. A processing method for splitting thread spool, comprising:

taking a plurality of sensor equipped stepping motors to serve as traction power for thread extraction;

driving a ceramic rotator and a flexible tube with said stepping motor;

clamping said resin thread tightly and pulling it for splitting to obtain finer threads similarly; and pulling the split resin thread to reach a winding spool for being wound to form a yarn spool pending knitting into silk socks.

* * * * *